US007279140B2

(12) United States Patent
Myers et al.

(10) Patent No.: US 7,279,140 B2
(45) Date of Patent: Oct. 9, 2007

(54) CATALYTIC CONVERTER WITH INTEGRAL OXYGEN SENSOR

(75) Inventors: Stephen J. Myers, Owosso, MI (US); Jeffrey B. Hardesty, Byron, MI (US); Dana M. Serrels, Davison, MI (US)

(73) Assignee: Delphi Technologies, Inc., Troy, MI (US)

( * ) Notice: Subject to any disclaimer, the term of this patent is extended or adjusted under 35 U.S.C. 154(b) by 621 days.

(21) Appl. No.: 09/903,983

(22) Filed: Jul. 12, 2001

(65) Prior Publication Data

US 2003/0010017 A1 Jan. 16, 2003

(51) Int. Cl.
*F01N 3/28* (2006.01)
*F01N 7/14* (2006.01)
*B01D 53/94* (2006.01)

(52) U.S. Cl. ..... 422/177; 422/179; 422/177; 422/180; 60/277; 60/323

(58) Field of Classification Search ..... 422/177, 422/179, 180; 60/276, 299
See application file for complete search history.

(56) References Cited

U.S. PATENT DOCUMENTS 4,454,741 A 6/1984 Hoogenboom ..... 72/71
4,883,643 A * 11/1989 Nishio et al. ..... 422/94
5,615,551 A * 4/1997 Matsushima ..... 60/276
6,338,827 B1 1/2002 Nelson
6,354,903 B1 3/2002 Nelson
6,361,821 B1 3/2002 Anderson et al.
6,391,822 B1 5/2002 Dou et al.
6,455,463 B1 9/2002 Labarge et al.
6,464,945 B1 10/2002 Hemingway
6,555,070 B1 * 4/2003 Kruger ..... 422/179
6,624,113 B2 9/2003 Labarge et al.
6,643,928 B2 11/2003 Hardesty et al.
2001/0025419 A1 * 10/2001 Celerier et al. ..... 29/890.08

FOREIGN PATENT DOCUMENTS

DE 19811569 A1 9/1999
EP 992659 * 4/2000
WO WO-9845584 A1 10/1998

* cited by examiner

*Primary Examiner*—Glenn Caldarola
*Assistant Examiner*—Kaity Handal
(74) *Attorney, Agent, or Firm*—Paul L. Marshall

(57) ABSTRACT

An exhaust system comprising a catalytic converter unit, a bushing element provided in a shell wall of the catalytic converter unit, and an oxygen sensor positioned within exhaust flow of the catalytic converter unit and extending through the bushing element and having a connector disposed in intimate contact with the bushing element, and a method of positioning such an oxygen sensor in an exhaust system component.

16 Claims, 3 Drawing Sheets

CATALYTIC CONVERTER WITH INTEGRAL OXYGEN SENSOR

BACKGROUND OF THE INVENTION

Oxygen sensors (or exhaust constituent sensors) have been used for many years in automotive vehicles to sense the presence of constituents (e.g., oxygen, hydrocarbons, nitrous oxides) in an exhaust gas flow and to sense and/or signal, for example, when an internal combustion engine switches from rich to lean or lean to rich operation.

Because automotive oxygen sensors are required to be positioned within the exhaust gas flow and be mounted within a component of the vehicle exhaust system, oxygen sensor designs must provide for durable sensors and secure mounting. The oxygen sensor is exposed to and must be able to withstand vibration and jarring such as would occur from vehicle operation, or from shock produced from the occasional stone or other small road debris that may happen to be thrown at the sensor, for example, by the vehicle's tires.

Current oxygen sensor design limitations severely limit positioning and configuration of oxygen sensors within an exhaust system. Foremost among these limitations is the requirement that an oxygen sensor be mounted on a flat surface. This is necessitated by the fact that sensors require a complete seal around their mountings for proper operation of the sensors and to avoid negative effects on emissions and performance. Typically, the sensors are mounted utilizing a fitting that is drilled and fabricated in a convenient section of exhaust tubing.

Currently, primary methods for fabricating bushings include use of cold heading, screw machining, or powdered metal for independent fabrication of a bushing. The prefabricated bushing is inserted into a hole pierced in the exhaust component, and the bushing is welded using metal inert gas (MIG) welding or projection welding. However, welding of prefabricated bushings to exhaust system components has produced a number of serious problems in the art, including weld spatter in threads, thread distortion, weld skips, or voids, created by welding heat. These defects usually translate to excess scrap and high rework costs.

Accordingly, there remains a need for an arrangement of an oxygen sensor within an exhaust system of an internal combustion engine that allows for greater flexibility in placement and minimized exposure to damage.

SUMMARY OF THE INVENTION

The disadvantages and drawbacks of the prior art are overcome by the exhaust system components and method of the present invention. In one embodiment, the exhaust system component comprises: a shell and an oxygen sensor. The shell has an outer wall and an inner wall, wherein the shell forms a bushing that defines an opening through and connects the outer wall and the inner wall. The oxygen sensor is disposed through the bushing such that a portion of the oxygen sensor extends into an injector portion of the component.

In another embodiment, the exhaust system component comprises: an endcone, an oxygen sensor, and a gasket. The endcone has an outer wall and an inner wall. The outer wall forms a bushing that defines an opening through and connects the outer wall and the inner wall. The bushing has a flat surface on an end opposite the inner wall. The oxygen sensor is disposed though the bushing such that a portion of the oxygen sensor extends into an interior portion of the component. The gasket is disposed in intimate contact with the flat surface and the oxygen sensor.

The above-described and other features and advantages of the present invention will be appreciated and understood by those skilled in the art from the following detailed description, drawings, and appended claims.

BRIEF DESCRIPTION OF THE DRAWINGS

The present invention will now be described, by way of example only, with reference to the accompanying drawings in which.

DETAILED DESCRIPTION

Figures 1, 2, 3, 4, 5, 6, 7, 8, 9:
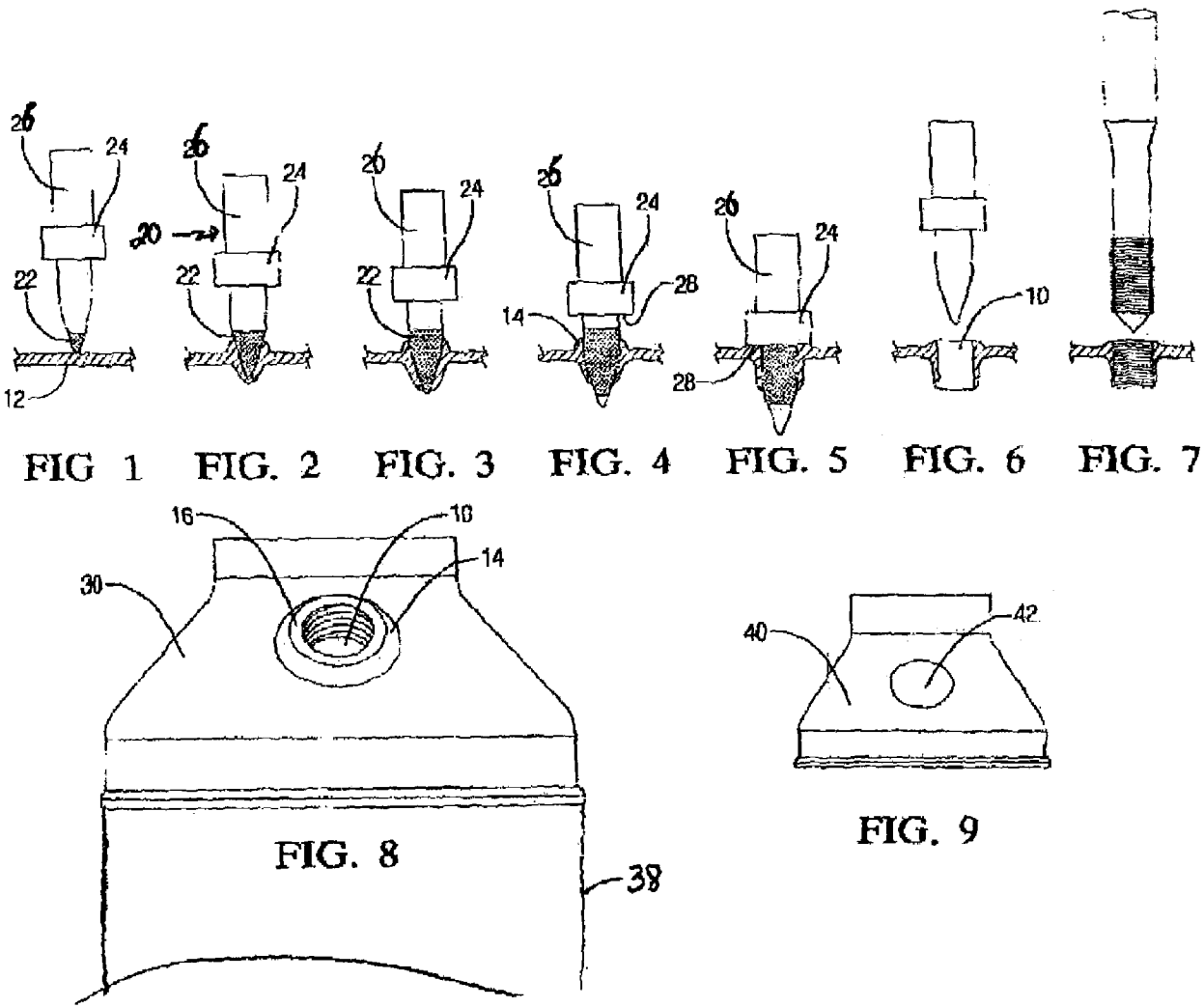
FIGS. 1-7 show a sequential, isolated view of an exemplary process of installing an oxygen sensor.
FIG. 8 shows a side view of a North American trapezoidal catalytic converter endcone exhaust component drilled by the method illustrated in FIGS. 1-7.
FIG. 9 is a cutaway view of the bushing formed in the material of the trapezoidal catalytic converter endcone exhaust component.

The present invention relates to an exhaust system comprising an oxygen sensor integrally mounted in the housing of a catalytic converter component in the exhaust line. Preferably, an oxygen sensor is mounted to the exhaust system component with integral high seal bushings, preferably having flat head mounts. The oxygen sensor can be any conventional sensor such as those conventionally employed in automotive exhaust systems. This sensor should have a mounting surface for connecting the sensor to the exhaust system.

The exhaust system component which comprises a catalytic converter, preferably is an endcone for a catalytic converter, and preferably comprises an integral, seal bushing at the point where it is desired to mount the oxygen sensor.

The exhaust system comprises a catalytic converter unit, a bushing element provided in a shell wall of the catalytic converter unit, and an oxygen sensor positioned within exhaust flow of the catalytic converter unit and extending through the bushing element and having a connector disposed in intimate contact with the bushing element. In a preferred arrangement, a bushing element is provided in a housing wall of an endcone of a catalytic converter, and an oxygen sensor having a connector is disposed in intimate contact with said bushing element to thereby mount the sensor in the exhaust flow. By mounting the oxygen sensor through the catalytic converter endcone, the sensor no longer extends radially out from the centerline of the exhaust flow, but rather is positioned at an angle to the centerline of the exhaust component (e.g., at an angle less than 90 degrees) and, accordingly, facilitates packaging the system underneath a vehicle.

The disclosed exhaust system integrates an $O_2$ sensor into a catalytic converter unit, preferably an endcone assembly. The catalytic converter and endcone may be either internally insulated or non-internally insulated. The mat insulating material typically between the inner and outer housing layers of the converter endcone should be protected from the exhaust gases in order to maintain control of the outer skin temperature as well as prevent erosion of the insulation material sandwiched between the outer and inner cone surfaces. Therefore, it is preferred in mounting the oxygen sensor in the endcone to fabricate a bushing accomplishing a seal between the inner and outer endcones. Flats may be formed in the inner and outer endcone surfaces to facilitate good fit-up either for flow drilling or welding bushing applications.

The oxygen sensor bushing through which the sensor is mounted may be formed into the shell of the converter, preferably at the tapered endcone, by form drilling, as described in detail herein, or welded into the endcone using techniques such as arc welding, friction/inertia welding, rotated drawn arc welding, flash/forge welding, metal inert gas (MIG) welding, or other such suitable welding methods.

A preferred method for connecting an oxygen sensor to an exhaust system comprises contacting the outer sheet metal wall of an exhaust system component with a blunt rotated bit; the friction between the surfaces softening the material of the wall where said rotated bit contacts the exhaust system component, allowing the bit to be pushed through the outer and then inner walls; penetrating the softened material with said rotated bit to form an extruded skirt that can he roll formed and threaded to create a bushing; and, using a connector, mounting an oxygen sensor within the bushing. In a double-walled construction, such as a typical endcone arrangement, preferably, the extruded skirt material formed when penetrating the outer wall merges with the upset material formed when penetrating the inner wall, so as to result in a continuous connection between the two walls, that can be tapped to accept a threaded connector of an oxygen sensor.

Another suitable technique includes friction/inertia welding wherein a bushing (in this case tapered to contact the two layers of pre-drilled endcone wall material) is rotated at high speed and held against the sheet metal cone material. The heat generated by the friction softens the bushing and two layers of endcone wall material, which then are pressed together creating a sealing/structural bond.

In rotated drawn arc welding, a current is passed through a bushing component and a pre-drilled wall of a converter endcone. The parts then are moved apart (drawn) until an arc has the required energy to perform the welding process. A rotating magnetic field is then used to cause the arc to move around the circumference of the bushing (heating the circular future contact area). When the bushing and endcone parts are heated sufficiently, they then are forced together to form a bond.

In one embodiment, referring to FIGS. 1-8, the bushing is formed in the catalytic converter using a form drill process. As illustrated sequentially in the Figures, in this process, a rotated bit 20 contacts the wall material of an exhaust system to form bushing 10. As shown in FIG. 1, the rotated bit 20 first is applied to the outer surface of wall 12 with substantially constant pressure such that, at first, just its tip 22 makes contact with the outer surface of wall 12 of an exhaust system component. Friction from contact of the rotated bit 20 and the component wall material generates heat and causes the material to soften and displace. As pressure of the rotated bit 20 on the surface of wall 12 is maintained, the bit 20 begins to index down into the softened wall material, as is shown in FIGS. 2 and 3. Penetration of the exhaust component wall material occurs only when component material underneath the bit becomes softened throughout the thickness thereof incident the bit. Penetration of the bit 20 through the outer wall is shown in FIGS. 4 and 5.

Figure 10:
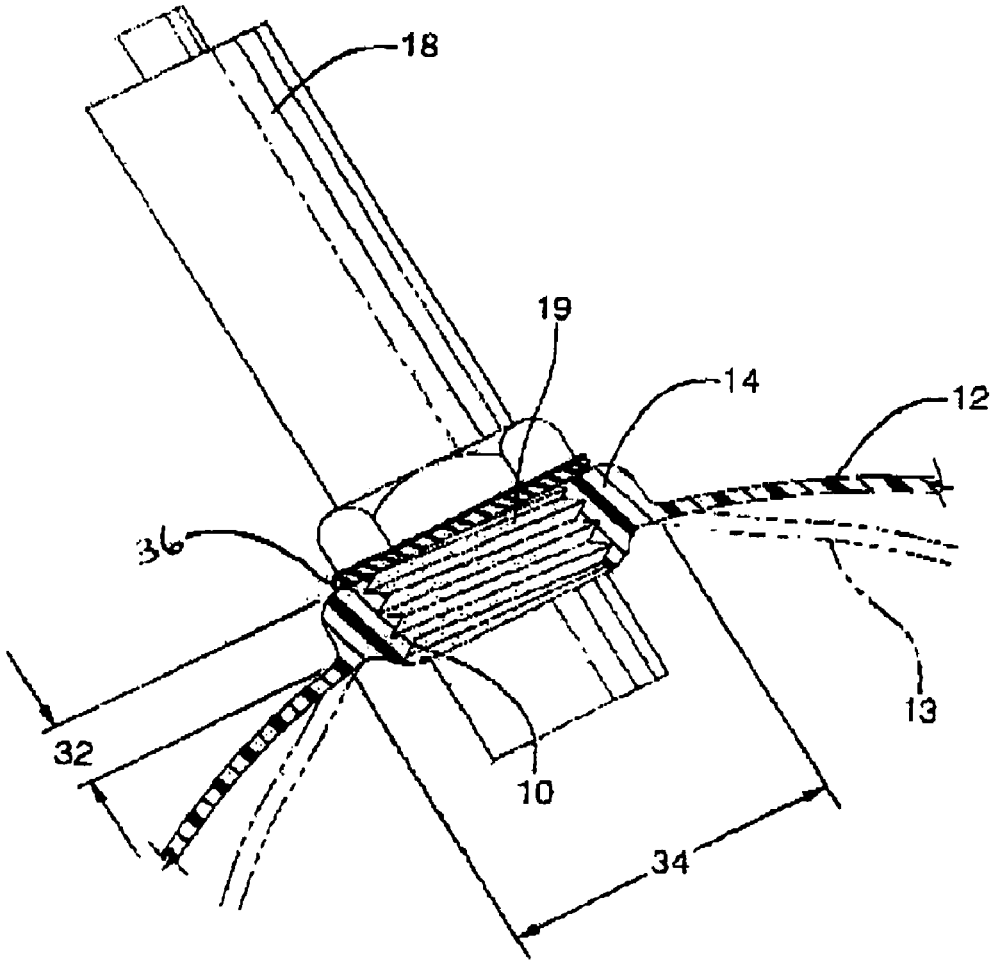
FIG. 10 is a side view of the inner shell for assembly with the trapezoidal catalytic converter endcone exhaust component.
Figure 11:
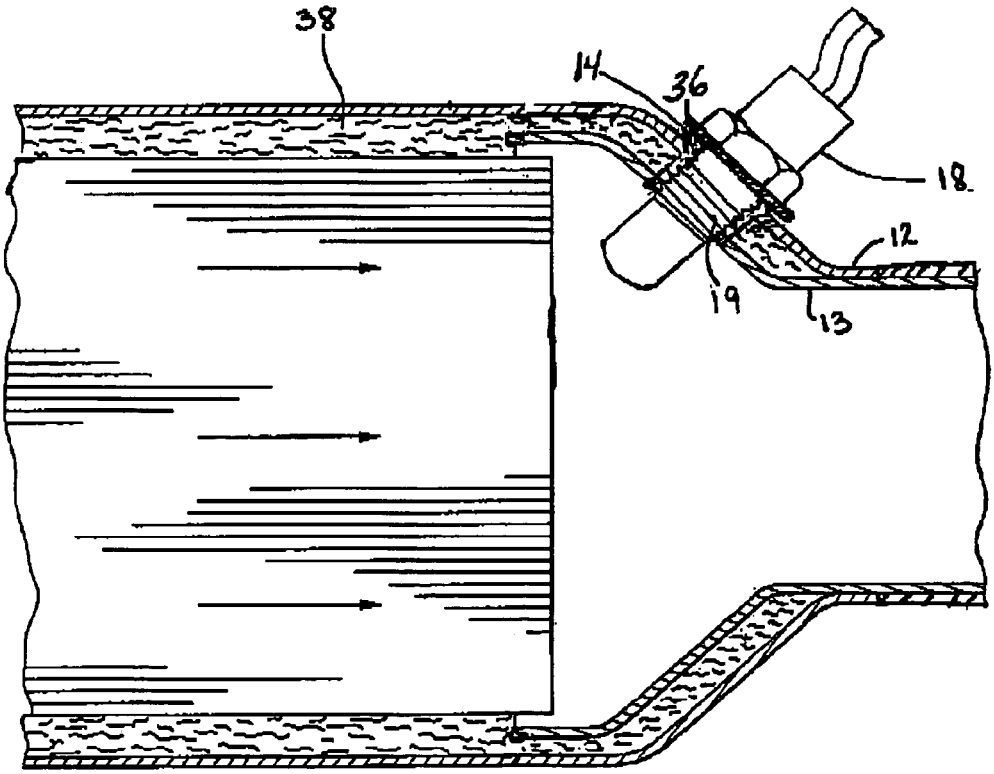
FIG. 11 is a partial side view of a catalytic converter with an oxygen sensor disposed through the double walled endcone.

The rotated bit may then be indexed down such that substantially complete penetration of the component outer wall material is effected. Although in FIGS. 1-7, a single wall arrangement is depicted, in a double wall arrangement, (as show in FIG. 11), the rotated bit will be indexed down and proceed to penetrate an inner wall in the same manner as illustrated with outer wall 12. Preferably, as depicted in FIGS. 10 and 11, the extruded skirt material formed when penetrating the outer wall 12 merges with the upset material formed when penetrating the inner wall 13, so as to result in a continuous connection between the two walls, that can be tapped to accept a threaded connector 19 of an oxygen sensor 18.

Preferably, the rotated bit 20 further comprises a collar 24 adjacent to the tip 22 disposed coaxially with the shaft 26 of the bit. The flatting surface 28 of the collar 24 preferably has a geometry which, when pressed against the softened component outer wall material displaced by the tip 22, forms the desired ring of upset material 14 with the desired substantially flat mounting surface 16. Preferably, surface 28 is substantially flat such that, when collar 24 contacts the softened component material 12, the upper surface of that material is substantially flattened, forming ring of upset material 14. This creates a substantially flat and even mounting surface 16, as is typically required by oxygen sensors to obtain a good seal.

The surface geometry of the collar surface, in any case, should conform to the geometry of the oxygen sensor to be mounted. If, for instance the sealing surface of the oxygen sensor is flat, the collar surface should be flat, while if the sealing surface of the oxygen sensor is beveled, the collar surface should be beveled. Otherwise, either where the geometries differ between the sensor mount and the collar surface, or where the rotated bit is not indexed down to completion such that the collar surface shapes the upset material appropriately, some additional means of sealing, such as a gasket 36 (see FIG. 11), should be employed to ensure the integrity of the seal.

It should be noted that, while it is preferred to use a flat mount on a curved surface, its use is not absolutely necessary to properly mount an oxygen sensor. Alternately, or in conjunction with a substantially flat mount, a gasket may be used to create a sealable mounting surface for embodiments using a rotated bit 20 lacking a collar 24 with a flatting surface 28. The gasket should be made of a material capable of maintaining structural integrity under the oxygen sensor operating conditions and sufficiently elastic to create a seal between slightly uneven upset material and the oxygen sensor to be installed. Such materials should also be sufficiently temperature resistant to typical exhaust system operating temperatures.

In forming the bushing, the shape of the rotated bit 20 is unimportant, except that it should have a generally widening diameter from tip to shaft and a sufficient diameter to form the desired busing size. A pointed tip is preferred to a blunt tip since pointed tips allow for softening to begin, with high pressure, at a localized point. Heat and friction generated from the point propagate out to surrounding material to cause the required phase change. Where the bit is indexed down consistently at a substantially maintained pressure, softening of adjacent material will allow for smooth indexing and penetration of the component material. Though a number of bit designs are conceivable, the best design to accomplish such smooth indexing is a lobed, conical bit. Specifically, the preferred shape of the rotated bit conforms to that described in U.S. Pat. No. 4,454,741 to Hoogenboom, which is incorporated herein by reference in its entirety where the contour of the rotated bit cross-section may be shown by the following formula:

$$R(\phi) = Ro - \frac{1}{2}e + \frac{1}{2}e\cos\left\{\arccos\left(\delta\sin^2 n\phi + \frac{|\cos n\phi|}{\cos n\phi}\sqrt{\delta^2\sin^4 n\phi - \delta^2\sin^2 n\phi + \cos^2 n\phi}\right) + a\right\}$$

in which the condition is valid for the solutions of R(ϕ):

$$(\sin n\phi) - \sin n\left\{\arccos\left(\delta\sin^2 n\phi + \frac{|\cos n\phi|}{\cos n\phi}\sqrt{\delta^2\sin^4 n\phi - \delta^2\sin^2 n\phi + \cos^2 n\phi}\right)\right\} \geq 0$$

and in which R=Radius vector from the drill center, Ro=radius vector in a starting point of the contour in one of the apexes of the polygon, ϕ=the angle between R and Ro, $e=R^{max}-R^{mm}$, δ is the modulation factor and α is the non-symmetry factor. The preference for this contouring lies in the fact that a continuous contour is obtained which is based on a complex harmonic curve, which provides a uniform load distribution along the part operating within the hole wall of the target material.

In addition to the bit geometry, a cutting fluid may be used to facilitate smooth penetration by the rotated bit. Cutting fluid acts to prevent the adhesion of molten or softened component material to the bit while promoting even formation of upset material. Since use of excess fluid can result in the conductance of heat away from the target material, which deters softening of the component material and results in substandard bushings, use of only a minimum of fluid is preferred.

After the drill has penetrated the component, forming the bushing and preferably upset material 14 has been flattened, threads are preferably formed about the inner surface of the bushing 10 to enable an oxygen sensor to be readily secured thereto. Bushing 10 may be threaded by methods known in the art including use of a tapped bit to cold work the threads. Exemplary threading is shown in FIG. 7.

Finally, as shown in FIG. 10, an oxygen sensor 18 can then be positioned through the endcone wall by threading the sensor 18 into the integral bushing 10 by means of threaded connector 19.

The present exhaust system and method will be illustrated further by review of the following examples, which are set forth in non-limiting detail:

EXAMPLE

A rotated bit was utilized to form an integral bushing on a North American trapezoid catalytic converter endcone assembly 30 (shown in FIG. 8). The North American trapezoid endcone assembly 30, which consists of an outer surface material, an inner cone 40, and a mat material 38 therebetween (see FIG. 11), was fabricated with a precut, 25 mm hole 42 located in the inner end cone 40 and through the mat material 38. The path of the rotated bit being cleared below, bushing formation was performed in the top side of the end cone 30 on the surface of the outer cone.

Design work took into consideration the angle that the oxygen sensor would be mounted, minimizing the radial distance the sensor would protrude, and reviewing the position of the sensor's louvered plenum with relationship to the catalyst. As shown in FIG. 10, it was determined that, on the surface of the North American trapezoid, the bushing 10 would have an upset surface having a height 32 of approximately 6.4 mm and a diameter 34 of approximately 30 mm.

The rotated bit process was evaluated on typical Tool Room End Mill Machines. The endcones were set up to locate a flat surface perpendicular to the axis of movement of the head. The rotated bit which operated at 2500 revolutions per minute (RPM), had a shaft diameter of 17.3 mm. The bit was manually lowered until the tip met the surface of the endcone with a force which was held constant while the material reached a molten state. Approximately when the material and the bit tip was viewed to be red hot, the constant force of the bit caused penetration of the material. The ram was indexed down quickly and consistently until both the outer wall and the inner wall were penetrated and the bit collar bottomed on the surface of the endcone and finished flattening the upset material. To prevent molten material from adhering to the surface of the bit, cutting fluid was used on the rotated bit.

Upon removal of the rotated bit and cooling of the target material, threads were formed on the inner surface of the bushing, which extended from the outer wall to the inner wall, by using a Flow Tap of size M18.5-1.5 thread, operated at 300 RPM. The ram was lowered again until the rotating Flow Tap engaged the bushing and continued until the bushing was completely threaded.

The application of the rotated bit and tapping was completed on the North American end cone assembly 30 (see FIG. 8-9) after assembling the end cones 30,40. In order to reduce the amount of material which would be displaced in the process of forming the bushing and to reduce the size of the inner skirt, a hole can be made through part or all of the way through the cone. For example, a hole 42 was precut in the inner end cone 40 and the mat material prior to assembly. The holes were made 30 mm in diameter; large enough to prevent potential interference with the rotated bit process. The end cones and mat material were assembled and located beneath the rotated bit at a predetermined angle that would result in the surface being perpendicular to the bit.

Each bushing showed good durability and zero leaking subsequent to oxygen sensor installation. It was further shown that threading subsequent to bushing formation produced acceptable results. Results indicated better bushing quality for a metal substrate at 0.072 inches thick, and acceptable quality on a thinner, 0.057 inch thick, trapezoid end cone. Specifically, the thicker material provided more upset material for formation of a better sealing surface. As such, results seem to indicate a preferred thickness of above about 0.05 inches for a 17.3 mm rotated bit operating on 409 Stainless Steel at 2,500 RPM.

Previously, oxygen sensors required substantially flat exhaust system component surfaces for mounting because bushings could not be formed on rounded components such that a complete seal could be obtained around the circumference of the oxygen sensor mount. Since the present system can incorporate a flat sealing surface, the oxygen sensors can be mounted where the need is greatest and not only where a flat surface is provided. As such, oxygen sensors can be mounted in curved areas of the catalytic converter, in converter end plates, or even in curves of exhaust piping as well as other locations.

It will be understood that a person skilled in the art may make modifications to the preferred embodiment shown herein within the scope and intent of the claims. While the present invention has been described as carried out in a specific embodiment thereof, it is not intended to be limited thereby but is intended to cover the invention broadly within the scope and spirit of the claims.

We claim:

1. A housing portion of an exhaust system component, the housing portion comprising:

an outer wall and an inner wall configured to provide a double wall arrangement, wherein a bushing is formed in the double wall arrangement from a displaced portion of the outer wall and a displaced portion of the inner wall, wherein the displaced portion of the inner wall and the displaced portion of the outer wall are merged together to define the bushing and the bushing defines an opening through the outer wall and the inner wall.

2. The housing portion of claim 1, wherein the bushing has a flat surface on an end opposite the inner wall the flat surface providing a mounting surface for a sensor.

3. The housing portion of claim 1, further comprising insulation disposed between the outer wall and the inner wall and about the bushing.

4. The housing portion of claim 1, wherein the bushing is formed in a rounded portion of the housing portion.

5. The housing portion of claim 1, wherein the housing portion is an end-cone of the exhaust treatment device.

6. The housing portion of claim 1, wherein a plurality of threads are formed in the bushing.

7. A housing portion as in claim 1, wherein the bushing is formed by a flowdrilling process and the busing further comprises a mounting surface.

8. An end cone of an exhaust treatment device, comprising:

an outer wall defining an exterior surface of the end cone;

an inner wall disposed within an inner area defined by the outer wall, wherein portions of the inner wall are in a facing spaced relationship with respect to the outer wall;

a bushing formed by merged displaced portions of the inner wall and the outer wall; and an opening extending from the exterior of the end cone to an inner chamber defined by the inner wall.

9. The end cone as in claim 8, wherein the bushing secures the inner wall to the outer wall.

10. The end cone as in claim 8, further comprising insulation disposed between the outer wall and the inner wall and about a periphery of the bushing disposed between the inner wall and the outer wall.

11. The end cone as in claim 8, wherein the exterior surface of the end cone is curved and a portion of the bushing is configured to have a flat surface disposed about a periphery of the opening of the bushing, wherein the flat surface is positioned away from the exterior surface of the end cone.

12. The end cone as in claim 11, further comprising a plurality of threads formed in the opening of the bushing.

13. The end cone as in claim 11, further comprising a sensor secured to the bushing.

14. The end cone as in claim 8, wherein the bushing further comprises a surface configured to engage a portion of a sensor secured to the bushing, wherein the surface is positioned away from the exterior surface of the end cone and wherein the exterior surface of the end cone is curved.

15. The end cone as in claim 14, wherein the bushing is formed by a flowdrilling process.

16. The end cone as in claim 8, wherein the bushing is formed by a flowdrilling process.

* * * * *